United States Patent [19]

Schrock

[11] 4,439,874

[45] Apr. 3, 1984

[54] WATER CLOSET RIM AND VENTING PROCESS THEREFOR

[75] Inventor: Donald C. Schrock, Carmel, Ind.

[73] Assignee: Masco Corporation of Indiana, Taylor, Mich.

[21] Appl. No.: 415,355

[22] Filed: Sep. 7, 1982

[51] Int. Cl.[3] ..... E03D 3/00

[52] U.S. Cl. ..... 4/300; 4/332; 4/661; 4/349

[58] Field of Search ..... 4/209, 211, 216, 300, 4/329, 332, 347–349, 352, 250, 420, 661

[56] References Cited

U.S. PATENT DOCUMENTS

| | | | |
|---|---|---|---|
| 1,070,245 | 7/1913 | Glenon | 4/250 |
| 1,261,561 | 4/1918 | Landmann | 4/349 |
| 1,533,860 | 4/1925 | Hoge | 4/349 |
| 1,675,841 | 7/1928 | Cohoon | 4/349 |
| 3,568,216 | 3/1971 | Valdespino | 4/349 |

*Primary Examiner*—Stephen Marcus
*Assistant Examiner*—Kenneth S. Putnam
*Attorney, Agent, or Firm*—Steven L. Permut; E. Dennis O'Connor; Leon E. Redman

[57] ABSTRACT

A quiet water closet rim and a method for venting air from a rim cavity of a water closet. The rim has a horizontally oriented annular cavity and is selectively supplied with pressurized water by a flush mechanism. A series of perforations in the rim permits the pressurized water within the rim cavity to exit the rim in the form of a spray. The rim is also provided with a vent passageway having an inlet open into an upper portion of the cavity and an outlet open into the atmosphere. As pressurized water fills the cavity, a portion of the air within the upper portion of the cavity is vented through the vent passageway.

19 Claims, 8 Drawing Figures

WATER CLOSET RIM AND VENTING PROCESS THEREFOR

BACKGROUND

The present invention relates to water closet rims and more particularly to a method for venting air from such rims to reduce the noise level during a flushing operation. The present invention also relates to water closet rims incorporating the method of the present invention.

Water closets typically are provided with a bowl, a hollow perforated annular rim around the upper edge of the bowl and a flush mechanism selectively operable to deliver a supply of pressurized water to the rim. The pressurized water delivered by the flush mechanism swirls through the rim and sprays out of perforations in the rim into the bowl to clean the bowl. Examples of water closet rims can be found in U.S. Pat. Nos. 1,070,245 (issued Aug. 12, 1913), 1,261,561 (issued Apr. 2, 1918), 1,533,860 (issued Jan. 15, 1923), 1,675,841 (issued July 3, 1923) and 3,568,216 (issued Mar. 9, 1971).

In recent years, many water closets have been devised which use a smaller amount of water for each flush cycle than previously was necessary. Such water closets often have smaller rim cavities and smaller perforations in the rim cavity than conventional water closets. While a certain amount of noise emanates from any water closet rim, the newer water conservation water closets have an increased tendency to emit undesirable noise during a flushing operation. The user hears various sounds, such as hissing, gurgling, whistling, aspirating and squealing noises as a mixture of water and air are forced through the perforations in the rim by the water pressure. What is needed, then, is an inexpensive, reliable method to reduce or to eliminate these noises.

The object of the present invention is to provide a method for venting air from a water closet rim to reduce the level of noise emanating from the rim during a flushing operation. Another object of the present invention is to provide a quiet and inexpensive rim for a water closet.

SUMMARY

The present invention provides an inexpensive and quiet rim for a water closet. The present invention also provides an inexpensive method for reducing the noise level of an existing rim by venting air from the rim.

The rim of the present invention has a horizontally disposed annular cavity which is selectively supplied with pressurized water from a flush mechanism. The rim further has a series of perforations into the cavity whereby pressurized water within the cavity is permitted to exit from the rim. The rim is also provided with a vent passageway having an inlet open into an upper portion of the cavity and an outlet open into the atmosphere. During a flushing operation, a portion of the air within the cavity is vented through the vent passageway as pressurized water fills the cavity.

The many objects, features, and advantages of the water closet rim and the venting process of the present invention will become apparent to those skilled in the art when the following detailed description of the preferred embodiment is read together with the drawing.

DETAILED DESCRIPTION OF THE PREFERRED EMBODIMENT

Figure 1:
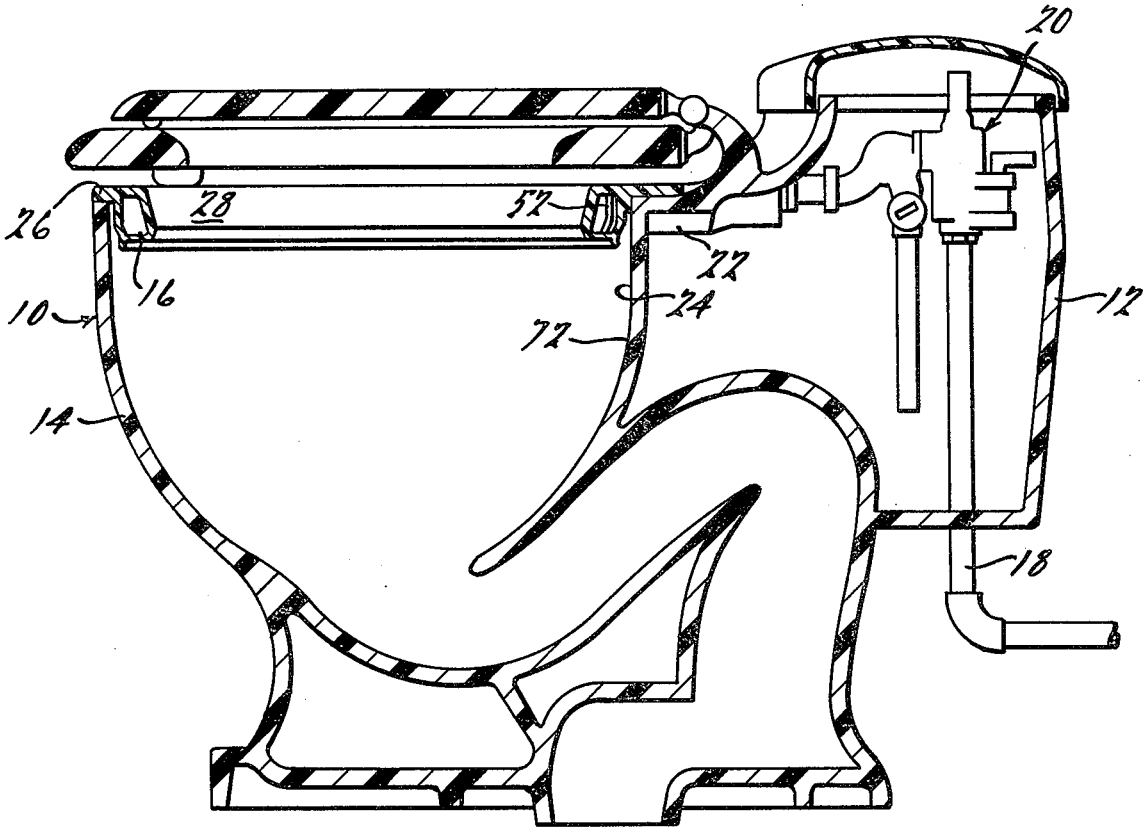
FIG. 1 is a sectional view taken through a water closet having a rim and a vent tube constructed in accordance with the present invention.

Refer now to the drawing, and more particularly to FIG. 1 thereof, illustrating an example of a water closet 10 suitable for utilizing the venting process of the present invention. The water closet 10 illustrated is a one piece water closet having a tank 12 and a bowl 14. A hollow annular rim 16, described later in great detail, is provided around the uppermost portion of the bowl 14 and is generally parallel to the ground. The tank 12 is supplied with water by means of a supply line 18. A flush mechanism 20 is provided within the tank 12 and is selectively operable to deliver pressurized water from the tank 12 to the rim 16 through a rim inlet line 22. As will be described later in detail, the pressurized water delivered to the rim 16 by the flush mechanism 20 is directed by the rim 16 towards the inner surface 24 of the bowl to clean the inner surface of the bowl. The design and operation of each of the above-recited elements of the water closet are well known in the art.

Figure 2:
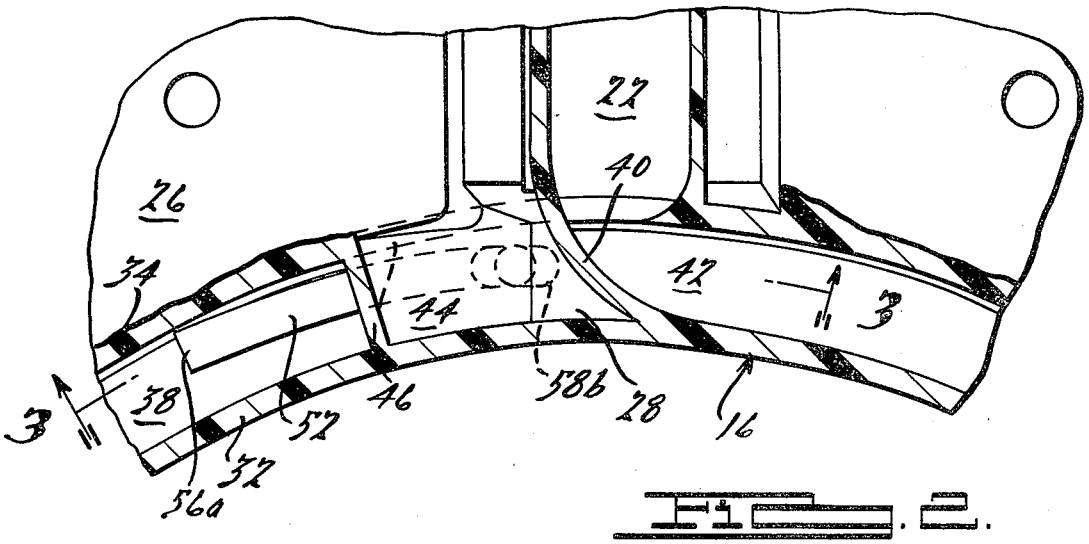
FIG. 2 is a top view, with portions cut away, of a portion of the rim of FIG. 1.
Figure 3:
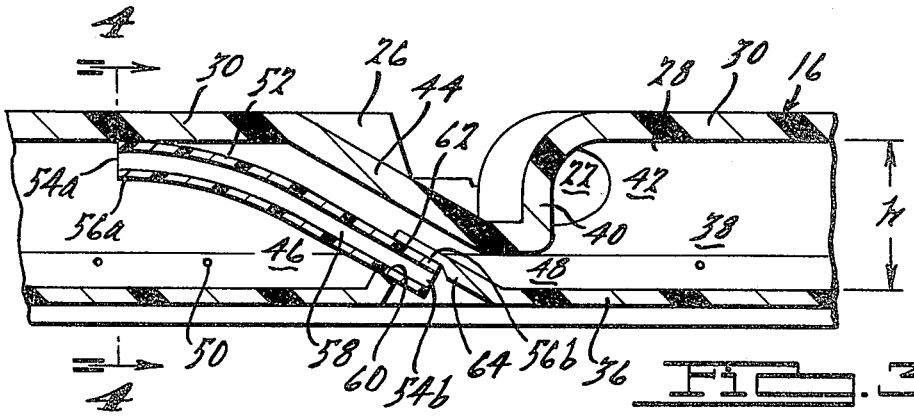
FIG. 3 is a sectional view along line 3—3 of FIG. 2.
Figure 4:
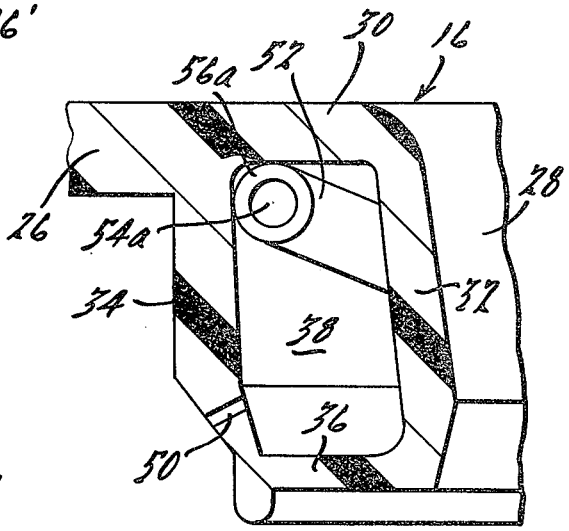
FIG. 4 is a sectional view taken along line 4—4 of FIG. 3.

FIGS. 2, 3 and 4 show the details of an example of a rim 16 according to the present invention. In the example illustrated, the rim 16 is a plastic molded element having an outwardly extending flat annular flange 26 (FIGS. 1, 2 and 4). The flange 26 is interconnected with the uppermost portion of the bowl 14 (FIG. 1) by means not illustrated but well known in the art.

The rim 16 also has a hollow annular portion 28 extending from the shoulder 26 inwardly towards the center of the bowl 14 and downwardly into the bowl. The annular portion 28 has a top wall 30 (FIGS. 3 and 4) extending inwardly from the flange 26. An inner cylindrical wall 32 and an outer cylindrical wall 34 (FIGS. 2 and 4) each extend downwardly from the top wall 30 into the bowl 14. An annular bottom wall 36 (FIGS. 3 and 4) is provided between the lowermost ends of the inner cylindrical wall 32 and the outer cylindrical wall 34.

The walls 30 through 36 enclose a generally annular rim cavity 38. The rim cavity 38 is interconnected with the rim inlet line 22, as shown in FIG. 2. A portion of the inlet line 22 is formed integrally with the rim 16 and is provided with an arcuate wall 40 (FIGS. 2 and 3) that projects partially into the cavity 38. The pressurized water which is delivered from the flush mechanism 20 through inlet line 22 into the cavity 38 directed by the wall 40 into a clockwise flow of water through the cavity 38, as viewed in FIG. 2. The portion 42 of the rim cavity 38 which is near the wall 40 defines an upstream portion of the water passageway through the rim cavity 38.

The rim 16 is also provided with a downwardly sloping wall 44 projecting partially into a downstream portion 46 of the rim cavity 38. The wall 44 is located a short distance from the wall 40 and counterclockwise therefrom. A small passageway 48 (FIG. 3) below the lowermost ends of the walls 40 and 42 interconnects the upstream portion 42 of the rim cavity 38 with the downstream portion 46 of the rim cavity and permits the pressurized water to continue to swirl in a clockwise direction through the rim cavity 38 past the downstream portion 46.

The rim 16 is also provided with a series of perforations 50 (FIGS. 3 and 4) in the outer cylindrical wall 34 of the annular portion 28. The perforations 50 permit the pressurized water within the rim 16 to spray outwardly from the rim and to thereby wash down the inside surface 24 of the bowl 14.

A vent tube 52 is provided in the downstream portion 46 of the rim cavity 38 to vent air from the top of the rim cavity. The length of vent tube 52 is substantially greater than the height "h" (FIG. 3) of the cavity 38. In the example shown, the length of the vent tube 52 is approximately double the height "h". The vent tube 52 is preferably comprised of a resilient material.

As shown in FIG. 3, the vent tube 52 has an inlet **54*a* at its uppermost end 56*a*, an outlet 54*b* at its lowermost end 56*b* and a vent passageway 58 extending between the inlet and the outlet. The vent tube 52 is attached to the rim 16 by being inserted through an aperture 60 in the bottom wall 36 of the annular portion 28 of the rim 16. As the vent tube 52 is forced upwardly through the aperture 60, the uppermost end 56*a* of the vent tube encounters the wall 44 and is guided in an upstream direction by the wall 44 until the end 56*a* of the tube rests against the upper wall 30 of the cavity 38. Therefore, as seen in the drawing, the uppermost end 56*a* of the vent tube 52 is almost horizontal and points upstream. An interference fit between the lowermost end 56 of the tube and the aperture 60 forms a seal between the vent tube 52 and the rim 16**.

As best depicted in FIG. 3, a concavity 62 may be provided in the bottom wall 36 of the annular portion 28 of the rim 16 around the aperture 58. The concavity 62 is provided to guide the vent tube 52 into the rim cavity 38 at an angle towards the upstream direction. A boss 64 may be provided in the concavity 62. The boss 64 cooperates with the lowermost end **56*b* of the vent tube to prevent accidental removal of the vent tube 52 after it has been inserted into the rim cavity 38**.

The operation of the rim 16 and the vent tube 52 is as follows. As pressurized water enters the upstream portion 42 of the rim cavity 38, the air within the rim cavity is pressurized. In conventional rims, the air within the rim cavity is pushed forward by the advancing water and is forced, along with some of the water, through the perforations 50 generating undesirable noises. In the exemplary rim 16 described above, however, a portion of the air within the rim is permitted to exit through the vent passageway 58 in the vent tube 52. The inlet **54*a* at the uppermost end 56*a* of the vent passageway is located near the top of the rim cavity 38 so that air can be vented from the rim cavity without losing a substantial amount of water from the rim cavity 38**.

When the rim cavity 38 is completely filled with pressurized water, a small portion of the pressurized water will leave the rim by way of the vent passageway 52 in the form of a solid column of water. This column of water will wash down the back portion 72 (FIG. 1) of the inside surface 24 of the bowl 14 and will aid in washing down the bowl.

It should be noted that the uppermost end **56*a* of the tube 52 is generally parallel to the top wall 30 and the bottom wall 36 of the rim 16. The vent passageway 58 is gradually redirected downwardly therefrom. This is a preferred path for the passageway 58 because the air within the rim cavity 38 is already forced by the advancing pressurized water during a flushing operation to move in a clockwise direction parallel to the top wall and the bottom wall of the rim. The air will be vented efficiently by the vent passageway 58 as described above since the air will flow smoothly into and through the vent passageway 56**.

An example of a water closet rim 16' having a vent passageway 58' (FIGS. 5 and 6) formed integrally with the rim is illustrated in FIGS. 5, 6, 7 and 8. The particular configuration of the downstream portion 46' (FIG. 5) of the rim 16' that is illustrated in FIGS. 5 through 8 is the best mode contemplated by the inventors for forming the vent passageway 58' integrally with the rim 16' when the rim 16' is formed by the method known in the art as blow molding.

Figure 5:
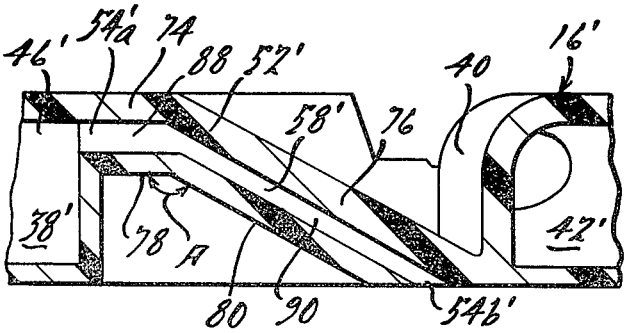
FIGS. 5 and 6 are sectional views similar to FIGS. 3 and 4, respectively, except that the rim shown in FIGS. 5 and 6 does not have a vent tube but instead is provided with a vent passageway formed integrally with the rim.
Figure 6:
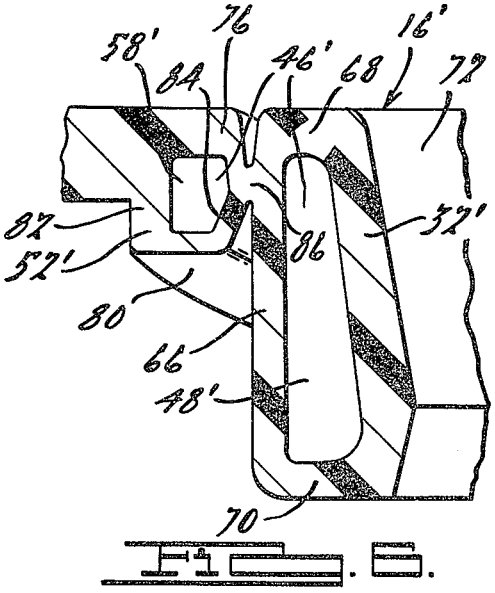

As shown in FIG. 6, the downstream portion 46' (FIG. 5) of the rim cavity 38' is divided into two adjacent passageways. One of the passageways is the bypass passageway 48' which interconnects the downstream portion 46' of the rim cavity 38' with the upstream portion 42' (FIG. 5) of the cavity. The bypass passageway 48' has the same height as the rim cavity 38' in general but is narrower than the remainder of the rim cavity. The other passageway is the vent passageway 58' (FIGS. 5 and 6) formed adjacent to the downstream portion 46'. The vent passageway 58' is adapted to direct a portion of the air in the upper portion of the cavity 38' from the rim cavity in the same manner as vent passageway 58 through the vent tube 52 described previously.

Figure 7:
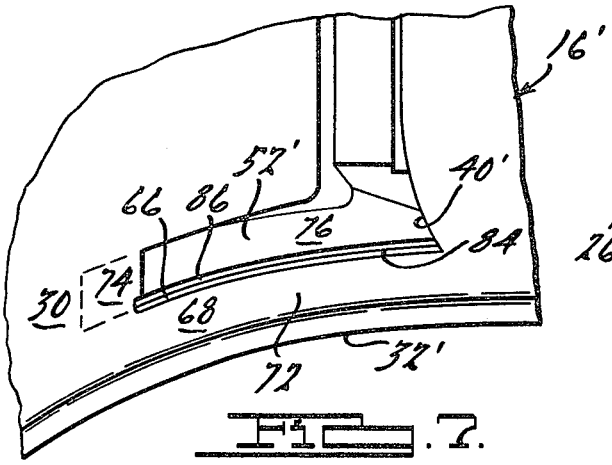
FIGS. 7 and 8 are top and bottom views, respectively, of the rim of FIG. 5.
Figure 8:
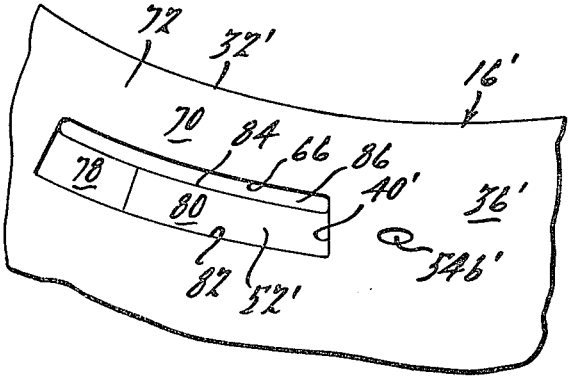

As illustrated in FIGS. 6, 7 and 8, the inner cylindrical wall 32' of the rim 16' is unchanged from the inner cylindrical wall 32 of the rim 16. An intermediate wall 66 is provided in the downstream portion 46' of the rim and is parallel to the inner cylindrical wall 32' and spaced outwardly therefrom. An upper wall 68 (FIGS. 6 and 7) extends between the upper edges of the walls 32' and 66 and is coplanar with the top wall 30' (FIG. 7) of the rim 16'. A lower wall 70 (FIGS. 6 and 8) extends between the lower edges of the walls 32' and 66 and is coplanar with the bottom wall 36' of the rim 16'. The walls 32', 66, 68 and 70 define a bypass portion 72 of the rim 16' and surround the bypass passageway 48'.

Adjacent to the bypass portion 72 of the rim 16' is a vent portion 52' having the vent passageway 58' therethrough. The venting portion 52' has an upper wall having a horizontal wall portion 74 (FIGS. 5 and 7) extending from the top wall 30' and a downwardly sloping upper wall portion 76 (FIGS. 5, 6 and 7) extending from the horizontal wall portion 74 to a location near the junction of the inlet line wall 40' and the bottom wall 36'. The vent portion 52' further has a lower wall having a horizontal wall portion 78 (FIGS. 5 and 8) and a downwardly sloping wall portion 80 (FIGS. 5, 6 and 8) parallel to and spaced a short distance below the wall portions 74 and 76, respectively.

Referring to FIGS. 6 and 8, an outer wall 82 extends between the outer edges of the upper and lower walls of the vent portion 52'. Similarly, an inner wall 84 extends between the inner edges thereof. A web 86 interconnects the inner wall 84 of the vent portion 52' of the rim 16' with the intermediate wall 66 of the bypass portion 72 of the rim.

As shown in FIG. 5, the vent portion 52' of the rim is provided with an inlet 54a' interconnecting the upper portion of the rim cavity 38' with the venting passageway 58'. An outlet aperture 54b' interconnects the venting passageway 58' with the atmosphere at a location below the rim cavity 38'.

It should be noted that the vent passageway 58' has a horizontal portion 88 and a downwardly sloping portion 90. The angle "A", between the portions 88 and 90 of the venting passageway should preferably be no less than ninety degrees (90°) so that the air will move smoothly from the upper portions rim cavity 38'. In the example illustrated, "A" is approximately one hundred and thirty-five degrees (135°).

It is readily apparent that the water closet rim of the present invention is inexpensive to manufacture and is quieter during a flushing operation than many previous rims. It is also apparent that the present invention provides an inexpensive method for venting air from existing rims so as to reduce the noise level during a flushing operation.

The foregoing comprises a detailed description of the present invention by means of example. The above description includes the best mode contemplated by the inventor for carrying out the invention at the time of filing the present application. Other configurations for the vent passageway 58 or 58' are possible and will be more suitable when methods other than blow molding are used to form the rim 16. Many variations from the examples described herein will be apparent to those skilled in the art. Such variations are included within the scope of the present invention, which is intended to be limited only by the claims appended hereto.

What is claimed as novel is as follows:

1. A rim for a water closet having a bowl and flush means selectively operable to supply pressurized water to a rim, said rim comprising an annular main body adapted for interconnection in a horizontal orientation with said bowl, an annular cavity extending through said main body and having a downstream portion and an upstream portion, said flush means supplying pressurized water to said upstream portion of said annular cavity and directing the water towards said downstream portion of said annular cavity, a series of perforations in said rim in communication with said annular cavity whereby pressurized water supplied by said flush means to said annular cavity may exit said annular cavity and enter said bowl, and a venting passageway located in said downstream portion of said annular cavity and provided with an inlet and an outlet, said inlet being open to an upper portion of said annular cavity and said outlet being open to the ambient atmosphere at a location below the inlet, said vent passageway having a cross-sectional area substantially larger than the area of each said perforations;

whereby, as pressurized water is selectively supplied to said annular cavity and forces air through said cavity from said upstream portion to said downstream portion, a portion of said air is vented from said cavity through said vent passageway.

2. The water closet rim of claim 1 wherein said vent passageway is formed integrally with said rim.

3. The water closet rim of claim 1 wherein said vent passageway directs the air from the upper portion of said annular cavity into said bowl.

4. A rim for a water closet having a bowl and flush means selectively operable to supply pressurized water to a rim, said rim comprising an annular main body adapted for interconnection in a horizontal orientation with said bowl, an annular cavity extending through said main body and having a downstream portion and an upstream portion, said flush means supplying pressurized water to said upstream portion of said annular cavity and directing the water towards said downstream portion of said annular cavity, a series of perforations in said rim in communication with said annular cavity whereby pressurized water supplied by said flush means to said annular cavity may exit said annular cavity and enter said bowl, and a venting passageway located in said downstream portion of said annular cavity and provided with an inlet and an outlet, said inlet being open to an upper portion of said annular cavity and said outlet being open to the ambient atmosphere at a location below the inlet, the portion of said vent passageway near said inlet being approximately horizontal;

whereby, as pressurized water is selectively supplied to said annular cavity and forces air through said cavity from said upstream portion to said downstream portion, a portion of said air is vented from said cavity through said vent passageway.

5. The water closet rim of claim 4 wherein the portion of said vent passageway between the horizontal portion thereof and said outlet slopes downwardly from said horizontal portion in a downstream direction relative to said annular cavity and forms an angle with said horizontal portion of no less than ninety degrees (90°).

6. A rim for a water closet having a bowl and flush means selectively operable to supply pressurized water to a rim, said rim comprising an annular main body adapted for interconnection in a horizontal orientation with said bowl, an annular cavity extending through said main body and having a downstream portion and an upstream portion, said flush means supplying pressurized water to said upstream portion of said annular cavity and directing the water towards said downstream portion of said annular cavity, a series of perforations in said rim in communication with said annular cavity whereby pressurized water supplied by said flush means to said annular cavity may exit said annular cavity and enter said bowl, and a venting passageway located in said downstream portion of said annular cavity and provided with an inlet and an outlet, said inlet being open to an upper portion of said annular cavity and said outlet being open to the ambient atmosphere at a location below the inlet; the portion of said vent passageway near said inlet being approximately horizontal, said outlet being below said annular cavity;

whereby, as pressurized water is selectively supplied to said annular cavity and forces air through said cavity from said upstream portion to said downstream portion, a portion of said air is vented from said cavity through said vent passageway.

7. A rim for a water closet having a bowl and flush means selectively operable to supply pressurized water to a rim, said rim comprising an annular main body adapted for interconnection in a horizontal orientation with said bowl, an annular cavity extending through said main body and having a downstream portion and an upstream portion, said flush means supplying pressurized water to said upstream portion of said annular cavity and directing the water towards said downstream portion of said annular cavity, a series of perforations in said rim in communication with said annular cavity whereby pressurized water supplied by said flush means to said annular cavity may exit said annular cavity and enter said bowl, and a venting passageway located in said downstream portion of said annular cavity and provided with an inlet and an outlet, said inlet being open to an upper portion of said annular cavity and said outlet being open to the ambient atmosphere at a location below the inlet; the portion of said vent passageway near said inlet being approximately horizontal; an aperture in said rim and open into said cavity, a tube provided with two open ends and pressed through said aperture until a portion of said tube is within said cavity; whereby said vent passageway comprises the passageway through the center of said tube and whereby said inlet and said outlet are the open ends of said tube; and whereby, as pressurized water is selectively supplied to said annular cavity and forces air through said cavity from said upstream portion to said downstream portion, a portion of said air is vented from said cavity through said vent passageway.

8. The water closet rim of claim 7 further comprising seal means between said tube and the portion of said rim around said aperture to prevent the leakage of water therebetween.

9. The water closet rim of claim 7 further comprising stop means on said rim adapted to cooperate with said tube to inhibit unintentional separation of said tube from said rim.

10. A rim for a water closet having a bowl and flush means selectively operable to supply pressurized water to the rim, said rim comprising an annular main body adapted for interconnection in a horizontal orientation with said bowl, an annular cavity extending through said main body, a water passageway supplying pressurized water from said flush means to a first portion of said annular cavity and directing the water in a preselected direction through said annular cavity, a series of perforations in said rim into said rim cavity whereby pressurized water supplied by said flush means to said annular cavity may exit said annular cavity, a vent passageway located in a second portion of said annular cavity downstream of said inlet and provided with a cross-sectional area substantially larger than the cross-sectional area of said perforations, an inlet into said vent passageway interconnecting an upper region of a second portion of said annular cavity with said passageway, and an outlet in said vent passageway interconnecting said passageway with the ambient atmosphere at a location below a portion of said annular cavity and still further downstream from said second portion of said cavity;

whereby, as pressurized water is selectively supplied to said annular cavity and forces air through said cavity from said upstream portion to said downstream portion, a portion of said air is vented from said cavity through said vent passageway into said bowl.

11. The water closet rim of claim 10 wherein said venting passageway is formed integrally with said rim.

12. The water closet rim of claim 10 wherein the portion of said vent passageway near said inlet is approximately horizontal and wherein the portion of said vent passageway between the horizontal portion thereof and said outlet slopes downwardly from said horizontal portion forming an angle with said horizontal portion of no less than ninety degrees (90°).

13. The water closet rim of claim 10 further comprising an aperture in said rim into said cavity, a tube provided with two open ends and pressed into said aperture whereby said vent passageway comprises the passageway through the center of said tube and said inlet and outlet are the openings at the ends of said tube.

14. The water closet rim of claim 13 further comprising seal means between said tube and the portion of said rim around said aperture to prevent the leakage of water therebetween.

15. The water closet rim of claim 13 further comprising stop means on said rim adapted to cooperate with said tube to inhibit accidental separation of said tube from said rim.

16. A rim for a water closet having a bowl and flush means selectively operable to supply pressurized water to the rim, said rim comprising: an annular main body adapted for interconnection for horizontal orientation with said bowl, an annular cavity extending through said main body and having a downstream portion and an upstream portion, said flush means supplying pressurized water to said upstream portion of said annular cavity and directing the water towards said downstream portion of said annular cavity, a series of perforations in said rim in communication with annular cavity whereby pressurized water supplied by said flush means to said annular cavity may exit said annular cavity and enter said bowl and a venting passageway located in said downstream portion of said annular cavity and provided with an inlet and outlet, said inlet being open to an upper portion of said annular cavity and facing an upstream direction in said annular cavity, and said outlet being open to the ambient atmosphere at a location below the inlet and located further toward the downstream portion of said annular cavity than said inlet of said vent passageway.

17. A method for reducing the level of noise generated by a water closet rim during a flushing operation adapted for a water closet rim of the type having a horizontal annular rim cavity with a downstream portion and an upstream portion, a water inlet adapted to periodically supply pressurized water to said upstream portion of said rim cavity, and a series of perforations in said rim into said rim cavity whereby, during a flushing operation, pressurized water is supplied to said upstream portion of said rim cavity and advances along said rim cavity towards said downstream portion pushing air ahead of it; said method comprising directing a portion of the air advancing through said passageway into a generally horizontal vent passageway in an upper portion of the annular passageway, redirecting the air from said horizontal passageway therefrom along a sloping passageway forming an angle of no less than 90° with the generally horizontal passageway, and venting the air from said sloping passageway into the atmosphere at a location below said rim cavity.

18. The method of claim 17 wherein said venting passageway has a cross-sectional area substantially larger than the cross-sectional area of each of said perforations.

19. The method of claim 17 wherein said vent passageway is formed integrally with said rim.

* * * * *